United States Patent [19]

Gaines et al.

[11] Patent Number: 4,506,578

[45] Date of Patent: Mar. 26, 1985

[54] PNEUMATIC APPARATUS FOR ACTUATING METAL SHEAR

[76] Inventors: Harold S. Gaines, 1619 17th Ave., West, Bradenton, Fla. 33505; Leonard C. Ross, 1270 E. 348th St., Eastlake, Ohio 44094

[21] Appl. No.: 451,531

[22] Filed: Dec. 23, 1982

[51] Int. Cl.[3] ..... B26D 5/12

[52] U.S. Cl. ..... 83/583; 83/588; 83/639; 92/94; 100/269 A

[58] Field of Search ..... 83/639, 582, 583, 588, 83/590; 100/269 A; 92/94, 95, 96, 98 R

[56] References Cited

U.S. PATENT DOCUMENTS

| | | | |
|---|---|---|---|
| 2,103,317 | 12/1937 | Cavagnaro | 83/588 X |
| 2,108,253 | 2/1938 | Dense | 83/588 |
| 2,724,410 | 11/1955 | Vorech | 92/94 X |
| 3,065,997 | 11/1962 | Frankhouser | 92/94 X |
| 3,166,251 | 1/1965 | Stitt, Sr. et al. | 92/94 X |
| 3,230,812 | 1/1966 | Pucci et al. | 83/639 X |
| 3,822,627 | 7/1974 | Bianchi | 83/639 X |
| 4,277,996 | 7/1981 | Spengler | 83/639 X |

*Primary Examiner*—James M. Meister

*Attorney, Agent, or Firm*—Watts, Hoffmann, Fisher & Heinke Co.

[57] ABSTRACT

An apparatus for applying pneumatic force to a work piece comprising a pneumatic cylinder mechanism including a flexible diaphragm member for applying pneumatic force to a reciprocally mounted piston rod member for transferring force to a working tool element for applying working force to a work piece.

1 Claim, 7 Drawing Figures

PNEUMATIC APPARATUS FOR ACTUATING METAL SHEAR

TECHNICAL FIELD

The present invention relates in general to a force application apparatus, and more particularly relates to a pneumatically actuated apparatus for moving parts or severing materials. The invention specifically relates to such force applying apparatus which incorporates a fluid actuated cylinder that includes a flexible diaphragm for use in severing metals, such as in punch presses, shears or the like, and for moving parts such as baffles which can be effectively used singularly or in multiple combinations.

BACKGROUND OF THE INVENTION

Heretofore, devices have been known which are hydraulically or pneumatically actuated for various applications. In such prior art devices, it has been primarily known to employ hydraulically or pneumatically operated piston-cylinder arrangements to actuate a cutting implement, such as a knife or the like. It has been found, however, that such structures are not only space consuming but are generally costly to produce, and difficult to repair and maintain. Importantly, such prior devices, such as in the metal working (i.e. stamping) industry, require considerable expense in the form of electrical energy to operate and are susceptible to shutdown in the event of unforeseen power failures. It is significant, therefore, that during these times which are subject to severe energy "crises" that metal forming (i.e. cutting, shearing, stamping or the like) be performed at the least possible expense insofar as the cost of energy is concerned.

Examples of prior metal forming machines are disclosed, for example, in U.S. Pat. Nos. 2,501,685, 2,770,799, 2,816,608, 4,273,738 and 4,277,996.

SUMMARY OF THE INVENTION

The present invention relates to a pneumatically actuated metal working apparatus and particularly relates to such type of apparatus which can be employed singularly or in multiple combinations and in various angular orientations for use with various types of metal working machines, such as punch presses, metal shears, stamping machines or the like. The invention can be used to move working parts such as baffles or the like. The apparatus of the invention, in one form, includes a pneumatically actuated flexible diaphragm mechanism including a fluid pressure chamber having a resiliently biased piston rod member adapted to be vertically reciprocated in response to pneumatic actuation of the flexible diaphragm member. The piston rod member is operably connected, in one form, to a metal working member including a movable platen member adapted to detachably mount a metal working tool such as a die, cutting blade, punch, shear blade or the like. An internal stop member is operably connected to the piston rod member for limiting reciprocal movement of said piston rod member upon pneumatic actuation by said flexible diaphragm member. The movable platen member is mounted on a support frame which mounts an oppositely disposed base member with the platen and base members being resiliently mounted on said support frame. In the invention, a cam mechanism may be oppositely disposed between said support frame and said movable platen member to mechanically increase the vertical load forces imparted to said movable platen member relative to said base member upon reciprocation of said piston rod member.

In the invention, the apparatus provides a self-contained construction such that one or any number of units can be applied in single or multiple combinations for providing single or multiple metal working operations. Also, it will be seen that in the invention the individual apparatus units can be applied in side-by-side (tandem) relationship or may be disposed at any predetermined angular orientation relative to one another and/or to the work piece so that the individual apparatus units can be grouped or "stacked" to achieve, in effect, a three-dimensional metal working operation on the work piece or work pieces.

Accordingly, in the invention there is provided a new and novel metal working apparatus which incorporates a pneumatically actuatable diaphragm for generating and applying the work forces so as to provide a metal working apparatus that is of a simple yet rugged construction which is economical to construct and install, as well as to repair and maintain. Importantly, the invention provides such an apparatus either singularly or in combination which enables efficient utilization of available power sources but at reduced energy costs.

Other advantages and objects of the invention will become apparent as the following description proceeds when taken in conjunction with the accompanying drawings.

DESCRIPTION OF THE PREFERRED EMBODIMENTS

In general, the invention contemplates a pneumatic (air) cylinder mechanism which utilizes a flexible diaphragm as an operating function to actuate another type of movable component, such as a baffle of the like, or in metal working operations in driving a platen or the like, such as in cutting, punching, shearing operations or the like. Accordingly, as the present description proceeds reference will be made to a metal working operation, such as in a flying cut-off shear, for use in cutting or shearing metals such as in cutting endless sheet metals utilized in making roof gutters or the like. It will be readily understood, therefore, that the present invention is adaptable to many other applications as will become apparent upon an understanding of the manner in which the apparatus of the invention functions.

Figure 1:
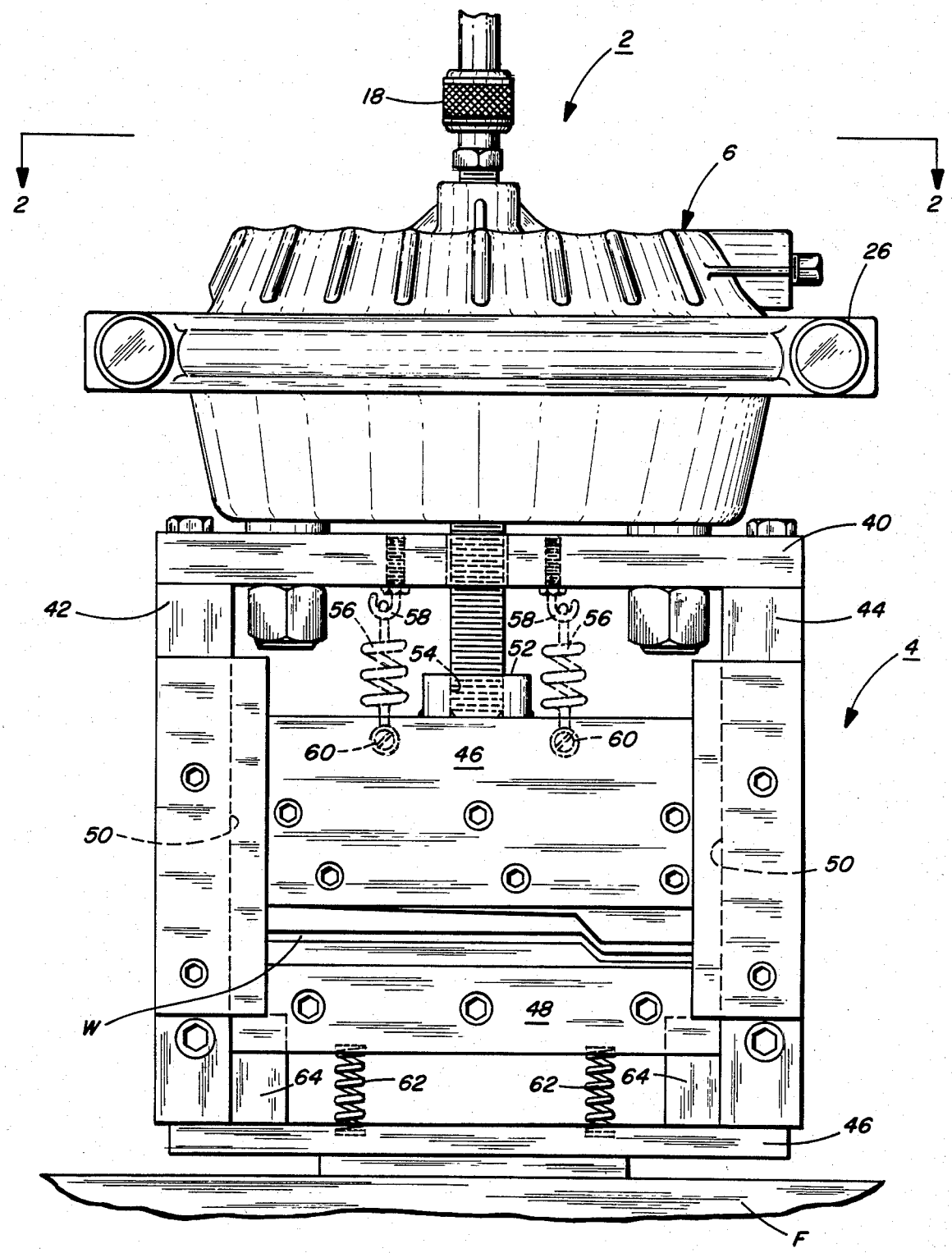
FIG. 1 is a fragmentary, front elevation view of the pneumatic metal working apparatus of the present invention.
Figure 2:
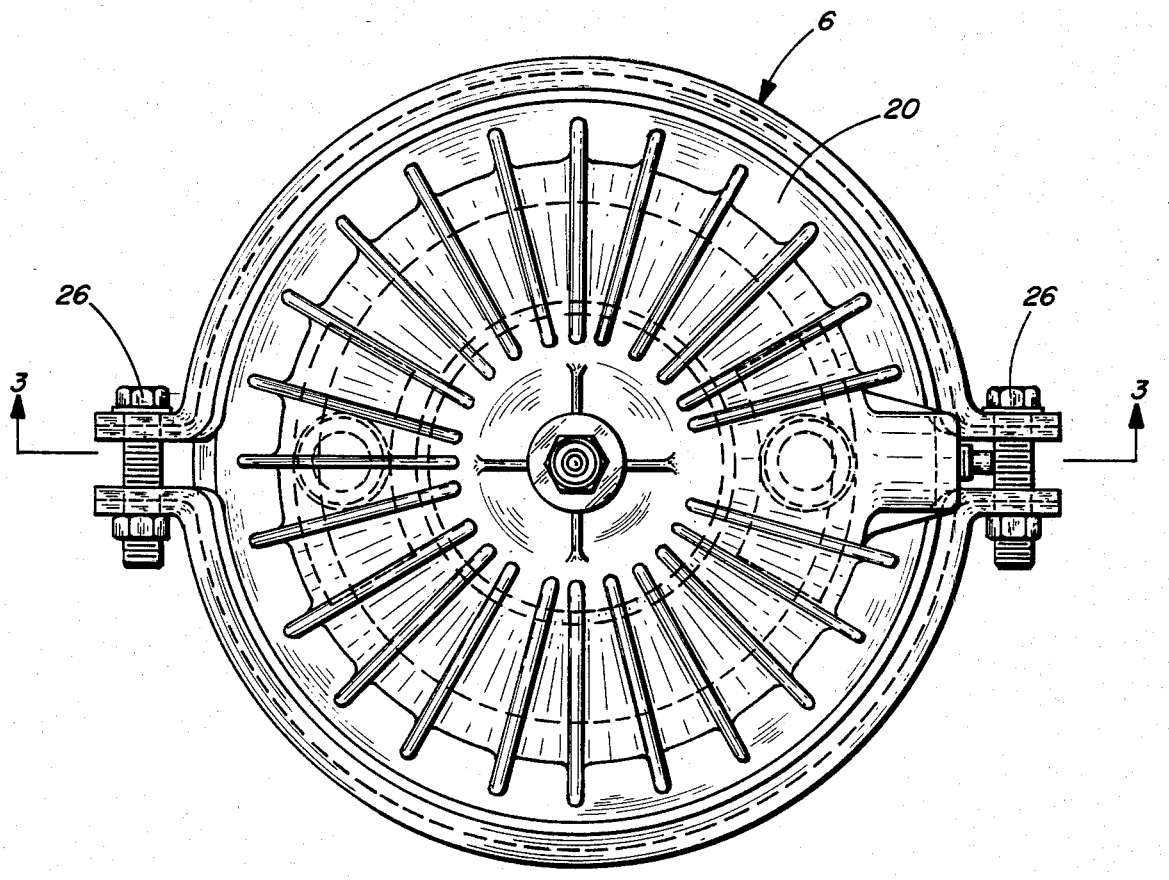
FIG. 2 is a fragmentary, front elevation view and partly in section taken along the line 2—2 of FIG. 1.
Figure 3:
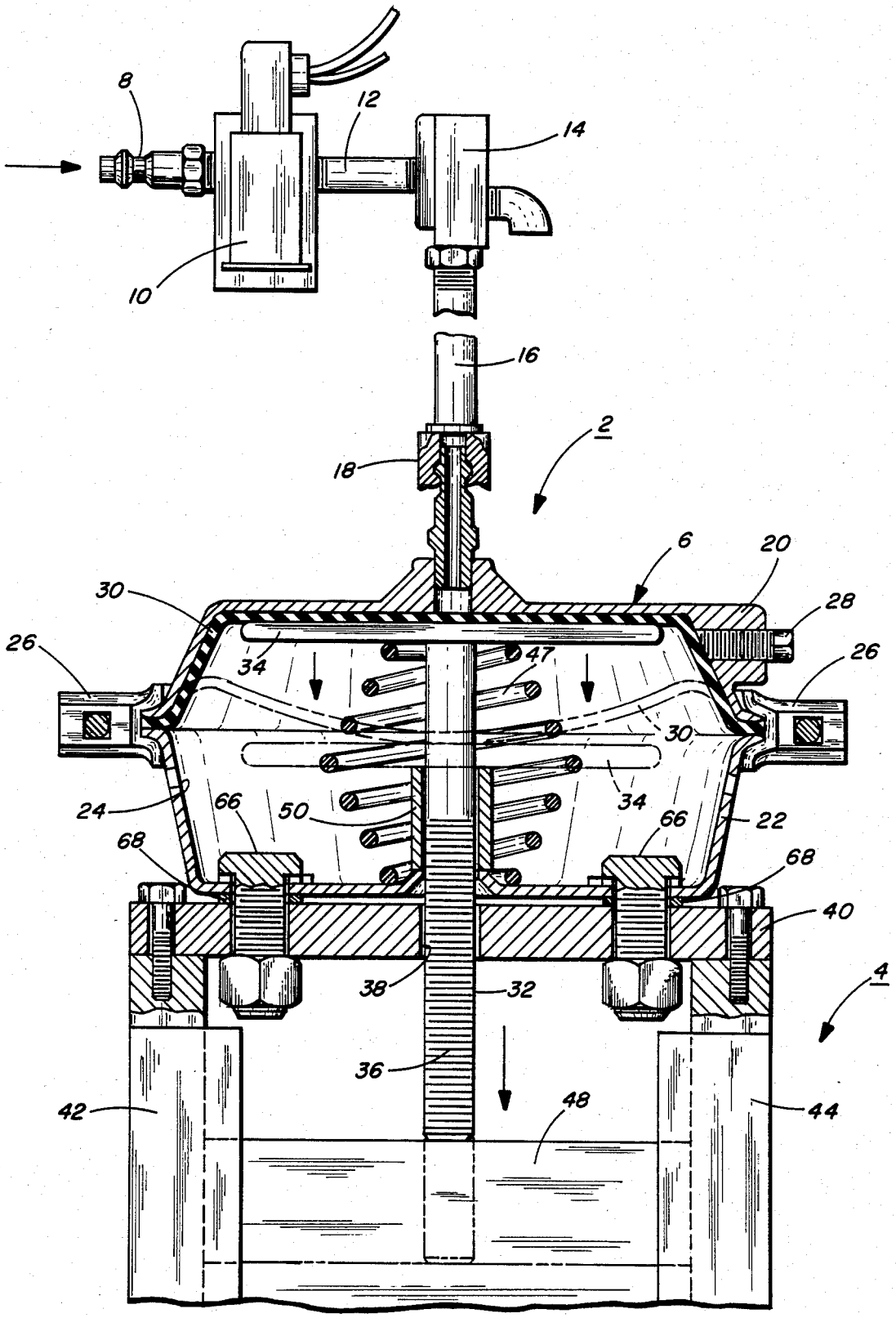
FIG. 3 is a top plan view looking in the direction of the line 2—2 of FIG. 1.

Referring now again to FIGS. 1 and 3 of the drawing, there is illustrated the pneumatic force applying apparatus, designated at 2, of the invention illustrated for use with a flying cut-off shear, designated generally 4, for shearing (cutting) a metal work piece. As illustrated, the apparatus 2 includes a pneumatic cylinder mechanism 6 which is pneumatically supplied, under pressure, through an air inlet port 8 which is controlled by a solenoid valve 10 which is connected via a nipple 12 to a shuttle valve 14. The valve 14 is connected via another nipple 16 to a quick-connect fitting 18 for detachable connection to the cylinder mechanism 6, as best illustrated in FIG. 3. Preferably, it has been found that the inlet port 8 should have a minimum ⅜" diameter for maximum air flow.

The cylinder mechanism 6 includes a two-part housing with mating sections 20 and 22 defining a cavity 24 therein. The sections 20 and 22 are joined by an endless clamp ring 26 which provides a pneumatic seal within the cavity 24. The housing may be provided with a threaded nut, as at 28, to provide a secondary or optionsl air inlet, as desired.

As illustrated, a flexible diaphragm member 30 made from an elastomeric (rubber) material is disposed within the upper section 20 of the housing and confined at its outer edge by the clamp 26. A power piston member defined by an elongated piston rod 32 with an integral transverse head member 34 is disposed for reciprocal vertical movement within the cavity 24 of the housing 6. The piston rod 32 has a threaded surface portion 36 which passes through an enlarged opening 38 provided in the cross frame member 40 of a generally H-shaped support frame structure defined by a pair of side support arms 42 and 44 which are mounted on a base plate member 46 which, in turn, may be mounted on the floor F. A resilient compression spring 48 is mounted within the cavity 24 and in encompassing relation around the piston rod so as to bear at one end against the head member 34 and at its other end against the bottom of the lower housing section 22. By this arrangement, there is provided a resilient biasing action against the head member 34 to return or move the piston rod member upwardly upon de-energization of the solenoid valve 10. In one form, the piston rod may be provided with a sleeve member 50 to control downward movement of the piston rod member 32 in a direction toward the work piece thereby to control the stroke of the work element.

The diaphragm mechanism 6 may be detachably connected to any suitable support frame, as desired. In the embodiment illustrated, the mechanism is mounted on a cross support member 40 of the frame structure 42 and 44 of the type for mounting, for example, an upper platen member 46 and a lower platen member 48 which rides in guides, as at 50, for vertical movement in forming a work piece W, such as by shearing, punching, stamping or the like. In the embodiment illustrated, the upper platen member 46 may be provided with a threaded nut member 52 which makes a threaded connection, as at 54, (FIG. 1) with the threaded portion 36 of the piston rod 32 for moving the upper platen 46 toward and away from the lower platen 48. A pair of resilient springs, as at 56, may be attached to hooks, as at 58, mounted on the cross member 40 and connected at their opposite ends via fasteners, as at 60, to the upper platen member 46 to resiliently mount the upper platen member 46 in the event it was desired not to have a fixed connection between the piston rod 32 and the upper platen member 46, as illustrated in FIG. 3. In such case, the springs 56 would maintain the upper platen rod 46 in biased relation against the piston rod so as to effect movement of the upper platen 46.

The lower platen 48 may also be resiliently mounted on a pair of springs 62 with suitable stop-blocks 64 being provided to limit downward movement of the lower platen 48 relative to the base member 46.

In the invention, the pneumatic diaphragm mechanism 6 may be detachably mounted on the support structure via suitable fasteners such as bolts 66 which can be provided with suitable resilient sealing rings 68 to ensure a pneumatic seal within the cavity 24 of the housing 6.

Figure 4:
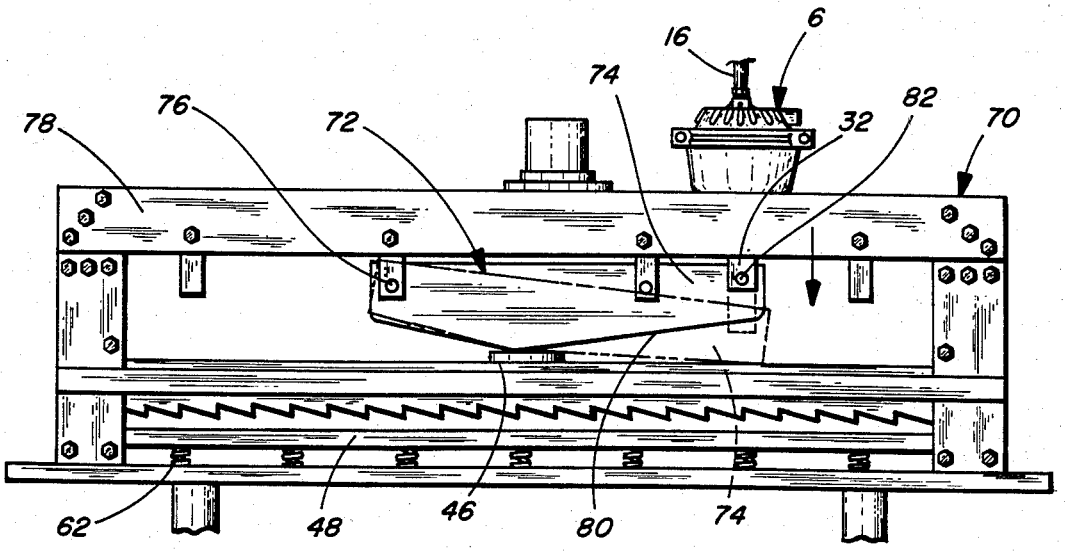
FIG. 4 is a fragmentary, front elevation view of a metal processing application of the apparatus of the invention illustrated for use with a pivotal cam mechanism for increasing the load force on the apparatus; and, FIGS. 5, 6 and 7 are generally diagramtic illustrations illustrating the multiple and various angular orientation applications of the pneumatic metal working apparatus made in accordance with the present invention.

In FIG. 4, there is diagramatically illustrated a press mechanism, designated generally at 70, which may suitably employ the working concept of the present invention. In this embodiment, the press mechanism 70 includes a cam device 72 including a pivot arm 74 which may be pivotally connected at one end, as at 76, to the upper stationary cross-member 78 of the press mechanism 70. The cam arm 74 may have an inclined surface, as at 80, with the free end being pivotally connected, as at 82, to the free end of the piston rod 32 of the diaphragm mechanism 6 for pivoting the cam arm about the pivot point 76 for increasing the load applying force on the upper platen 46 relative to the lower platen 48. Accordingly, by this arrangement it will be seen that the pneumatic diaphragm mechanism 6 may be employed in conjuction with a cam mechanism 72 to effect the load forces on any type of working tool, such as illustrated in FIG. 4.

Figure 5:
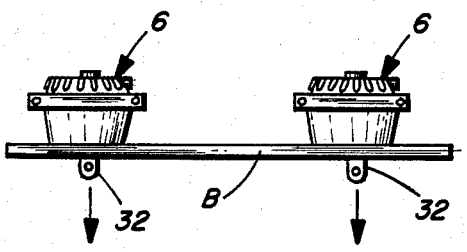
Figure 6:
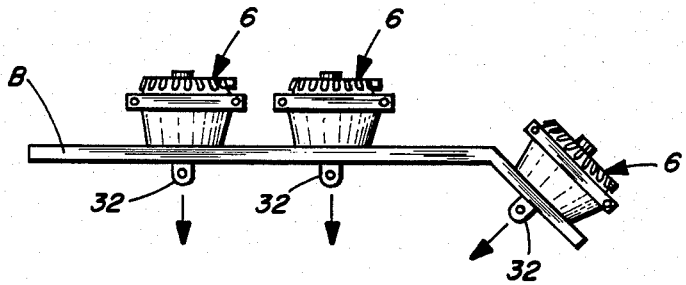
Figure 7:
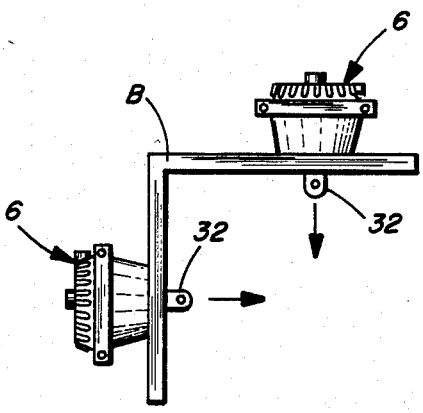

In FIGS. 5, 6 and 7 there is diagramatically illustrated various configurations and angular orientations of the pneumatic diaphragm mechanism 6 of the invention. In FIG. 5, two such mechanisms are illustrated in tandem relationship on a flat base member B. In FIG. 6, there is illustrated a "stacked" or tandem relationship and with another mechanism 6 disposed at an angle on the base B. In FIG. 7 there is a further modification of the invention where a pair of mechanisms 6 are disposed at right angles to one another on the base B. Accordingly, it will be seen that in the present invention the pneumatic force applying apparatus can be employed effectively either singly or in combination and in any angular orientation relative to the work piece, as desired.

In the invention, it will be recognized that the tonnage capacity for the length of cut and the gauge of the material, as in the case of a flying cut-off die, determine the size of the pneumatic diaphragm mechanism 6. It has been found in such case, that all of the port openings and pneumatic lines must have a minimum diameter of ⅜" to ensure proper speed of both the cutting and return action of the upper platen member 46. In such cases, the quick-connect fittings may be replaced with direct fittings to maintain the minimum port size. Other advantages and objects of the invention are incorporated in the following claims.

We claim:

1. An apparatus for applying force to a work piece comprising a pneumatic cylinder mechanism having a flexible diaphragm therein, a piston member resiliently mounted interiorily of said cylinder such that the piston member is caused to move upwardly and downwardly in response to pneumatic force applied to said flexible diaphragm, valve control means for regulating the amount of fluid pressure exerted on said flexible diaphragm, said piston rod member extending exteriorly in pneumatic sealed relation through said cylinder and adapted to be operatively connected at its free end to a movable forming tool element, said movable forming tool element being movable toward and away from a second forming tool element for applying a work forming force to a work piece disposed between said tool elements, wherein said movable tool element is mounted for reciprocal movement on a support frame structure, and resilient means resiliently mounting said tool element on said support frame structure, wherein electric solenoid control valve means is pneumatically connected to said cylinder for electrically controlling the amount of pneumatic pressure applied to said flexible diaphragm member, wherein a sleeve member is disposed around said piston rod member interiorly of said cylinder for limiting downward movement of said piston rod member interiorly of said cylinder, and wherein said second tool element is movably mounted on a support frame structure, resilient means resiliently mounting said second tool element on said support frame structure.

* * * * *